United States Patent [19]

Bochan

[11] 4,091,546

[45] May 30, 1978

[54] LAUNDRY MACHINE AIR VENT

[75] Inventor: John Bochan, Louisville, Ky.

[73] Assignee: General Electric Company, Louisville, Ky.

[21] Appl. No.: 774,395

[22] Filed: Mar. 4, 1977

[51] Int. Cl.[2] ..... F26B 21/06

[52] U.S. Cl. ..... 34/73; 34/108

[58] Field of Search ..... 34/73, 76, 108

[56] References Cited

U.S. PATENT DOCUMENTS

| | | | |
|---|---|---|---|
| 3,242,584 | 3/1966 | Jacobs | 34/73 X |
| 3,622,134 | 11/1971 | Mazza | 34/108 X |
| 3,922,798 | 12/1975 | McMillan | 34/73 |

*Primary Examiner*—Edgar W. Geoghegan
*Attorney, Agent, or Firm*—Frederick P. Weidner; Francis H. Boos

[57] ABSTRACT

In a laundry machine having a horizontal axis rotatable drum and a door for access into the drum there is provided an air vent including a duct having one end in air flow communication with the interior of the drum and the opposite end in air flow communication with air outside the machine. The air vent also includes a flexible flap within the duct having one end free and movable from a vertical first position to a second position and the opposite end of the flap is secured to the duct. The flap has a dimension less than the inside lateral cross section of the duct. There is also a partition spaced from the free end of the flap when the flap is in the first vertical position and the partition has an opening smaller than the flap whereby the opening is covered when the machine is in operation and the flap is in the second position.

8 Claims, 3 Drawing Figures

LAUNDRY MACHINE AIR VENT

BACKGROUND OF THE INVENTION

1. Field of the Invention

The present invention relates to laundry machines such as automatic clothes dryers, and more particularly, to an air vent for use with such machines.

2. Description of the Prior Art

In automatic clothes dryers it is common to vent the warm moisture-laden exhaust air or vapor outside the machine and preferably even outside the house or building while air is constantly being introduced into the clothes dryer, heated and passed over the fabrics to be dried. It is not, however, always possible and, in fact, it may not be desirable to provide such a venting system for automatic clothes dryers in apartments or other high rise housing establishments. In drying fabrics in a clothes dryer it is highly desirable to be able to heat the air, pass the heated air over the fabrics to be dried and withdraw moisture therefrom, remove the hot moisture-laden air from the fabrics and introduce it into an apparatus that lowers the temperature of the moisture-laden air thereby condensing out moisture from the air, then recirculate the air through the clothes dyer. Condensing apparatus has been utilized in laundry machines, both combination clothes washers and dryers and automatic clothes dryers, for many years.

In laundry machines it may be desirable to have an air vent that allows air from outside the machine into the drum when the machine is not in operation. Such an air vent would be desirable in a laundry machine wherein there would not be sufficient oxygen supply in the drum to sustain life in the event a child was trapped in the drum with the door in a closed position. Such an air vent must, however, assume a closed condition during operation of the laundry machine so that the efficiency of the machine is not detrimentally affected by the admission of cold air from outside the machine. It is also important in such an air vent that it be located so that it will automatically open and close when it should and that its operation and function cannot be bypassed either by the machine or human failure.

It is therefore an object of the present invention to provide an air vent for a laundry machine which accomplishes the above mentioned desirable results.

SUMMARY OF THE INVENTION

In accordance with the present invention there is provided in a laundry machine having a horizontal axis rotatable drum and a door for access into the drum an air vent comprising a duct having one end in air flow communication with the interior of the drum and the opposite end in air flow communication with air outside the machine. The air vent also includes a flexible flap within the duct having one end free and movable from a vertical first position to a second position and the opposite end of the flap is secured to the duct. The flap has a dimension less than the inside lateral cross section of the duct so that in the vertical first position air may flow past the flap. There is also a partition spaced from the free end of the flap when the flap is in the first position, said partition having an opening smaller than the flap, whereby the opening is covered when the machine is in operation and the flap is in the second position thus preventing air from passing through the duct.

DESCRIPTION OF THE PREFERRED EMBODIMENT

Figure 1:
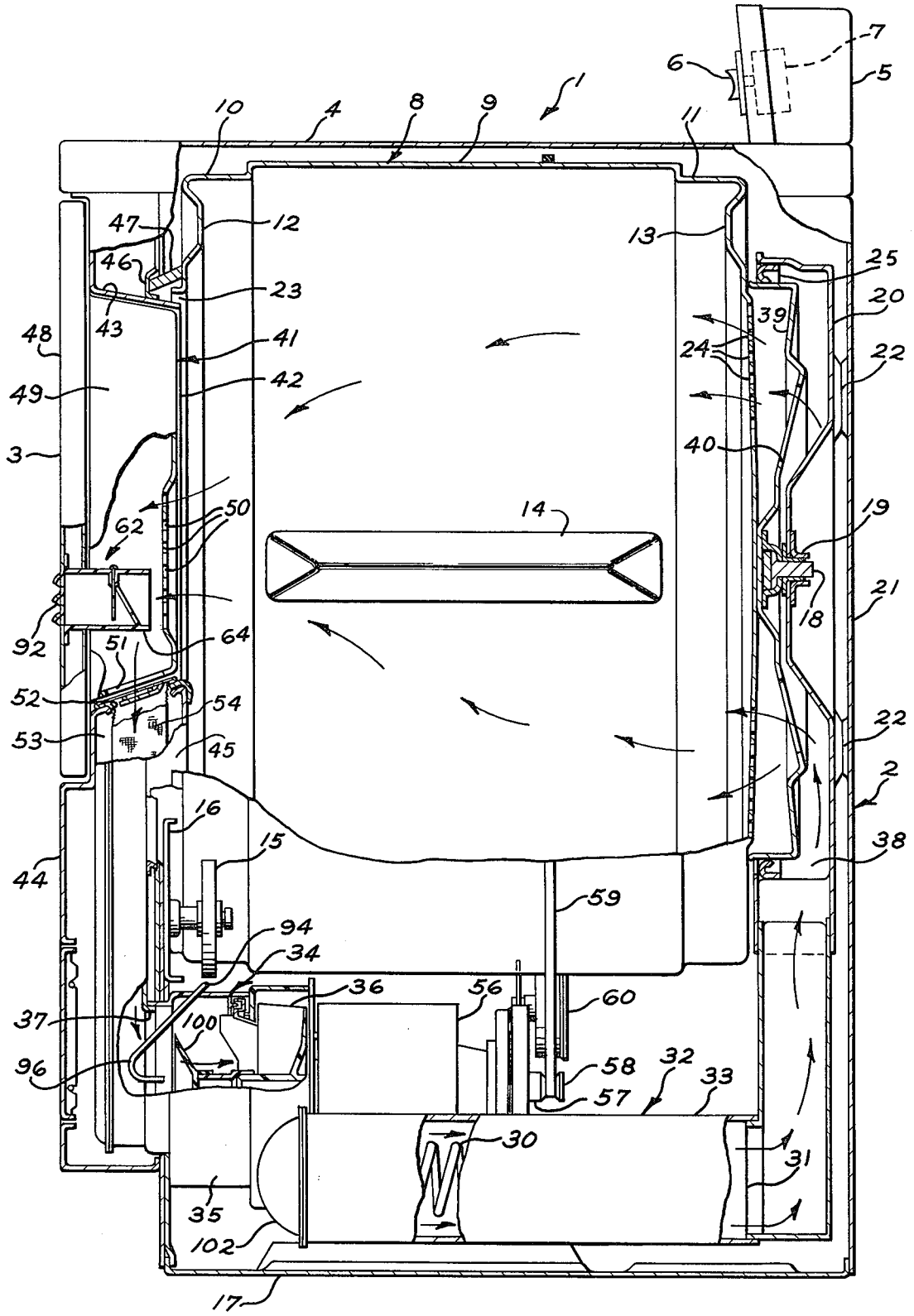
FIG. 1 is a side elevational view of a condenser type clothes dryer incorporating the air vent of the present invention, the view being partly broken away and partly in section to illustrate details.

Referring now to FIG. 1, the machine illustrated is a domestic fabric or clothes dryer generally indicated by the numeral 1. Dryer 1 includes a cabinet 2 having a front door 3 to provide access to the interior of the cabinet for loading and unloading clothes. Provided on the top 4 of cabinet 2 is a control panel 5 which may, in a conventional way, include a suitable manual control 6 connected to a control assembly 7 mounted in the panel 5. By manual setting of control 6, the machine may be caused to start and automatically proceed through a cycle of operation.

Within cabinet 2, there is provided a clothes tumbling chamber, or drum 8. Drum 8 is substantially cylindrical in shape, having a center cylindrical wall portion 9, and outer cylindrical wall portions 10 and 11 located respectfully adjacent an annular front wall 12 and a circular rear wall 13 of the drum. Wall portions 9, 10 and 11 are imperforate over their entire area so that the outer shell of the drum is imperforate. On the interior surface of wall portion 9 there are a plurality of clothes tumbling ribs 14 so that clothes are lifted up when the drum rotates, and then tumble back down to the bottom of the drum.

The front of the drum 8 may be rotatably supported within outer casing 2 by suitable idler wheels, one of which is indicated by the numeral 15. These wheels are rotatably secured to the top of a member 16 which extends up from the base 17 of the machine. The wheels 15 are disposed beneath the drum, in contact with portion 10, so as to support the portion 10 on each side to provide a stable support.

The rear end of drum 8 receives its support by means of a stub shaft 18 extending from the center of wall 13. Shaft 18 is secured within a bearing 19 formed in baffle-like structure 20, in turn, is rigidly secured to the back wall 21 of the cabinet 2 by any suitable means such as welding at a number of points 22. With the arrangement shown, the drum may rotate on a horizontal axis, with rollers 15 providing the front support and stub shaft 18 within bearing 19 providing the rear support.

In order to provide for the flow of a stream of drying air through the clothes drum, the drum is provided with a central aperture 23 defined by the front wall 12 and with a plurality of perforations 24 in the rear wall 13. Perforations 24 in the present case are formed to extend around the rear wall in an annulus.

The air provided to the drum is heated, as by an electrical resistance heating element 30, and issues from an outlet 31 of the heating unit 32. The heating unit 32 includes a heater housing 33 and the electrical resistance heating element 30. Heated air from the heating unit 32 enters a generally circular heat diffuser chamber 38 formed between the member 20 and a baffle 39 which is rigidly secured to the outer surface of wall 13. A flexible circumferential seal 25 is interposed between baffle 20 and the baffle 39 to provide a rear drum airseal and is secured to baffle 20 and contacts the rear wall of the rotating drum. Baffle 39 has openings 40 formed therein so that the heated air may flow from the chamber 38 through the openings 40 and perforations 24 into the drum 8.

The front opening 23 of the drum is substantially closed by means of a stationary bulkhead generally indicated by the numeral 41. Bulkhead 41 is made up of a number of adjacent members including the inner surface 42 of the access door 3, a stationary frame 43 formed as a flange of front wall 44 of the cabinet, the inner surface member 45 of an exhaust duct and an annular flange 46 mounted on the frame 43. It will be noted that a suitable clearance is provided between the inner edge of the aperture 23 and the edge of bulkhead 41 so that there is no rubbing between the drum and the bulkhead during rotation of the drum. In order to prevent a substantial air leakage through the aperture 23, a suitable ring seal 47 is secured to the flange 46 in sealing relationship with the exterior surface of the drum wall 12.

Central aperture 23, in addition to serving as part of the air flow passage to the drum, also serves as a means whereby clothes may be loaded into and unloaded from the drum. Door 3, whose inner surface forms part of the bulkhead closing the opening, is mounted on cabinet 2 so that when the door is open clothes may be inserted into and removed from the drum through the foor frame 43. It will be noted that the door includes an outer, flat imperforate section 48 and an inwardly extending hollow section 49 mounted on the flat outer section. Hollow section 49 extends into the door frame 43 when the door is closed, and the door surface 42, which comprises part of the combination bulkhead 41, is actually the inner wall of the hollow section.

The air outlet from the drum is provided by perforated openings 50 formed in the inner wall 42 of hollow door section 49. The bottom wall section of door 3 and the adjacent wall of door frame 43 are provided with aligned openings 51 and 52, opening 52 providing an entrance to duct 53 formed by the cooperation of member 45 with front wall 44. A lint trap 54 is positioned in the exhaust duct 53 and opening 52 and is supported by the door frame 43. Duct 53 leads downwardly and communicates with a condenser 34. The condenser housing 35 contains a blower 36 which is directly driven by motor 56. The blower 36 draws air through the duct 53 and introduces it into the condenser through an air inlet 37. The condenser 34 includes a liquid inlet means 94 which is connected to a source of water outside the machine. The inlet means 94 may conveniently be a tubular conduit 96 supported by a structure secured in a suitable fashion to the condenser housing 35. Spaced axially from the conduit 96 is a rotatable disc 100. As liquid from the conduit 96 is impinged on the disc 100 it creates a mist of liquid droplets within the housing 35 that causes the hot moisture-laden air passing through the mist to lose its moisture because the air temperature is lowered. The then cooled air reaches the blower 36 where it is directed to the heating unit 32 via duct 102 and again recirculated through the heating unit 32 and the clothes dryer.

In addition to driving the blower 36, motor 56 constitutes the means for effecting rotation of drum 8. In order to effect this rotation, motor 56 is provided with a shaft 57 having a small pulley 58 formed at one end thereof. A belt 59 extends around the pulley 58 and also entirely around the wall section 9 of drum 8. The relative circumferences of the pulley 58 and the wall section 9 cause the drum to be driven by the motor at a speed suitable to effect tumbling of clothes therein. In order to effect proper tensioning of the belt 59, a suitable belt tensioning idler assembly 60 is secured to the same support 61 which supports one end of the motor. Thus, the air is pulled through the drum and, at the same time, the fabrics in the drum are tumbled.

While there is shown and described a laundry machine which is of the type wherein air is pulled through the drum and is commonly referred to as a negative air pressure type machine there are also machines wherein air is forced through the drum and are commonly referred to as a positive air pressure type machine. Also, while the preferred embodiment shows a machine utilizing an electrical resistance heating element 30 as the heating means it will be understood that such laundry machines may also be heated by gas heating means and the particular heating means employed does not affect the invention herein.

Figure 2:
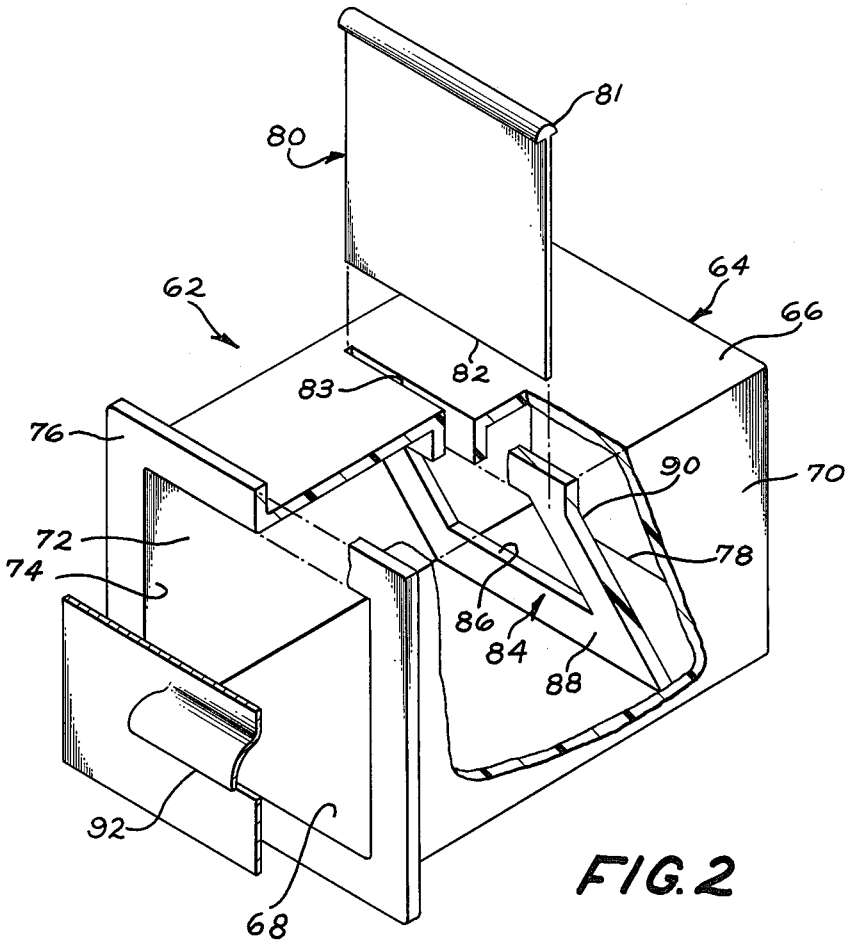
FIG. 2 is an exploded perspective view showing the air vent of the present invention.
Figure 3:
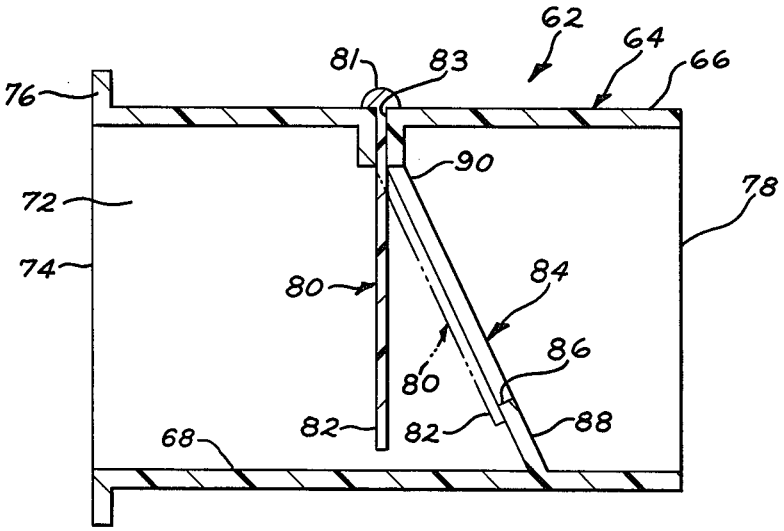
FIG. 3 is a side elevational cross sectional view of the air vent of the present invention.

With reference to FIGS. 2 and 3 in particular, the structure and arrangement of components of the air vent 62 will be discussed in detail. There is provided a duct 64 which is shown in rectangular shape and has a top wall 66, a bottom wall 68 and side walls 70 and 72. The front one end of the duct has an opening 74 surrounded by a peripheral flange 76 and at the opposite end of the duct there is an opening 78. Between the front opening 74 and the rear opening 78 there is within the duct a flap 80. The upper end of the flap 80 is secured to the duct 64 and preferably is secured to the top wall 66 and hangs vertically downward within the duct 64 such that the free unattached end 82 is spaced from the bottom wall 68. In this arrangement it is important that the flap 80 have a dimension less than the inside lateral cross section of the duct 64. The flap 80 is flexible and may be a flat hinged sheet of material or it can be made from any suitable flexible material. Preferably the flap 80 is made from silicone rubber which has the desirable properties of being very flexible and is relatively unaffected by heat. The flap 80 may be formed with a flanged head 81 that is wider than the thickness of the rest of the flap 80. Flap 80 is received through a slot 83 in the top wall 66 of the duct 64. The slot 83 is slightly larger than the flap 80 but smaller than the flanged head 81 so that when the flap 80 is inserted through slot 83 it assumes the position shown in FIG. 3.

The air vent 62 also includes a partition 84 located within the duct 64 and the partition is spaced from the free end 82 of the flap. The partition 84 has an opening 86 which is dimensioned to be smaller than the flap 80. It will be noted that the partition 84 is slanted relative to the vertical in that the bottom portion 88 is spaced from the vertical position of the flap 80 and the top 90 is adjacent to and abuts the flap where the flap is attached to the top wall 66 of the duct 64.

The flap 80 of the air vent 62, when subjected to almost static conditions, will assume a vertical first position as shown in FIG. 3. In this position air may pass through the duct 64 from opening 74 to opening 78. Also, the partition 84 and the hole or opening therein 86 allows the air to pass through the partition. If, however, the flap 80 is moved to a second position as shown in dotted line in FIG. 3 and since the flap dimension is larger than the partition opening 86 the opening 86 will be sealed when the flap 80 is in said second position.

The air vent 62 in the preferred embodiment is located in the door of the machine as shown in FIG. 1. The dimensions of the air vent 62 can vary depending upon the desired location of the air vent within the machine. For the duct 64 to receive air from outside the machine there is provided a louvered member 92. The opening 78 of the duct 64 is as noted in FIG. 1 in air communication with the interior of the drum 8. When the flap 80 is in the vertical first position as shown in FIGS. 1 and 3, air from outside the machine may pass through the louvered member 92 to the interior of the duct 64 past the flap 80 and through the opening 86 in the partition 84 and out the rear opening 78 of the duct 64 and thereon into the drum.

The operation of the air vent assembly is as follows: When the laundry machine 1 is not in use it is under a static condition wherein there is neither negative or positive air pressure in the drum 8. Should a child be trapped in the drum the breathing would cause only a very slight pressure differential from a completely static condition and would be insufficient, as compared to that created during operation of the machine, to move the flap 80 to its second position. In this condition then flap 80 of the air vent assembly 62 will be in a vertical first position as described above and the drum interior may receive air through the air vent assembly by air passing through the louvered member 92 past the flap 80 through the opening 86 in the partition 84 and out the rear opening 78 of the duct 64 and then on into the drum via perforated opening 50 and the drum's central aperture 23. In the operation of the machine it is highly desirable that the passageway through the duct 64 be blocked so that air from outside the machine cannot pass through the duct and thereby detrimentally affect the drying capacity of the machine by introducing cold outside air into the machine. In the machine operation there is provided a flow of a stream of drying air through the clothes dryer (as shown by arrows in FIG. 1). The heated air flows through the perforations 24 in the rear wall 13 of the drum to the interior of the drum 8 and then through the opening 23 in the front wall 12 of the drum into the bulkhead 41 through the perforated openings 50 provided therein around the exterior of the duct 64 and downwardly through the openings 51 and 52 and the lint trap 54 into the blower 36 where it is again recirculated through the machine. In this arrangement then it is noted that the blower which causes the air to flow to the machine is downstream from the drum 8 and thus there is provided a negative pressure type of machine. In this type of negative pressure machine the partition 84 of the air vent assembly 62 is located between the flap 80 when it is in its vertical first position and the rear opening 78. By this arrangement then as the machine is in operation the negative air pressure tends to draw air from outside the machine in through the louvered member 92 and this movement of air through the duct will cause the flap 80 to move to its second position abutting the partition 84 and thus sealing the opening 86 to prevent air passing therethrough. It will be recognized that if the laundry machine in which the air vent assembly is to be used is of the positive pressure type wherein heated air is forced through the drum then the partition 84 would be located on the opposite side and would be between the flap 80 when in its vertical first position and the outside of the machine or the louvered member 92. In that arrangement the positive air pressure would cause the flap 80 to assume its second position and again abut the partition and seal off the opening 86 through the duct 64 thus again preventing air from passing therethrough. It will be understood that the air vent 62 may be located in the machine anywhere it is desirable as long as it functions in the manner described above.

The foregoing is a description of the preferred embodiment of the invention. In accordance with the Patent Statutes, changes may be made in the disclosed device and the method in which it is employed without actually departing from the true spirit and scope of the invention as defined in the appended claims.

What is claimed is:

1. In a laundry machine having a horizontal axis rotatable drum and a door for access into the drum, an air vent comprising:

a duct having one end in air flow communication with the interior of the drum and the opposite end in air flow communication with air outside the machine, a flexible flap within the duct having one end free and movable from a vertical first position to a second position, and the opposite end secured to the duct, said flap having a dimension less than the inside lateral cross section of the duct, and a partition spaced from the free end of the flap when the flap is in the first position, said partition having an opening smaller than the flap, whereby the opening is covered when the machine is in operation and the flap is in the second position thus preventing air from passing through the duct.

2. In the laundry machine of claim 1 wherein the flap is a thin sheet of silicone rubber.

3. In the laundry machine of claim 1 wherein the flap is secured to the top of the duct and is vertically suspended within the duct.

4. The laundry machine of claim 1 wherein the partition at the top thereof is adjacent the secured end of the flap and the bottom of the partition is spaced from the flap when the flap is in its first position.

5. The laundry machine of claim 1 wherein the duct is in the door of the machine.

6. The laundry machine of claim 1 wherein the machine is of the type having a negative air pressure in the drum during machine operation and the partition is located between the flap and the drum.

7. The laundry machine of claim 1 wherein the machine is of the type having a positive air pressure in the drum during machine operation and the partition is located between the flap and the front of the door.

8. The laundry machine of claim 1 wherein the machine includes a condenser to remove moisture from air being recirculated through the machine.

* * * * *